US010631652B2

(12) United States Patent
Mackert

(10) Patent No.: US 10,631,652 B2
(45) Date of Patent: Apr. 28, 2020

(54) SEATING FURNITURE CHASSIS WITH A RETRACTABLE AND EXTENDABLE FOOTREST

(71) Applicant: Innotec Motion GmbH, Lippstadt (DE)

(72) Inventor: Michael Mackert, Rüthen (DE)

(73) Assignee: INNOTEC MOTION GMBH, Lippstadt (DE)

( * ) Notice: Subject to any disclaimer, the term of this patent is extended or adjusted under 35 U.S.C. 154(b) by 0 days.

(21) Appl. No.: 16/082,236

(22) PCT Filed: Mar. 11, 2016

(86) PCT No.: PCT/EP2016/055464
§ 371 (c)(1),
(2) Date: Sep. 4, 2018

(87) PCT Pub. No.: WO2017/153004
PCT Pub. Date: Sep. 14, 2017

(65) Prior Publication Data

US 2019/0357686 A1 Nov. 28, 2019

(51) Int. Cl.
*A47C 7/50* (2006.01)

(52) U.S. Cl.
CPC ..... *A47C 7/5068* (2018.08); *A47C 7/5062* (2018.08)

(58) Field of Classification Search
CPC ..... A47C 7/5068; A47C 7/5062
USPC ..... 297/423.2, 423.22, 423.23, 423.24, 297/423.26, 423.28, 423.3
See application file for complete search history.

(56) References Cited

U.S. PATENT DOCUMENTS 5,328,247 A * 7/1994 Lovins ..... A47C 7/506 297/423.3
6,517,160 B2 * 2/2003 Marcantoni ..... A47C 7/506 297/423.28
6,692,078 B2 * 2/2004 Pham ..... A47C 1/0342 297/423.2 X
6,695,406 B2 * 2/2004 Plant ..... B60N 2/34 297/423.26
6,773,074 B2 * 8/2004 Flory ..... B60N 2/995 297/423.36 X (Continued)

FOREIGN PATENT DOCUMENTS

DE 102009051576 A1 4/2011
JP 6036339 U 3/1985

(Continued)

OTHER PUBLICATIONS

International Search Report for corresponding PCT Application PCT/EP2016/055464, 4 pages, dated Oct. 14, 2016.

*Primary Examiner* — Rodney B White
(74) *Attorney, Agent, or Firm* — Edell, Shapiro & Finnan, LLC

(57) ABSTRACT

A seating furniture chassis comprises a retractable and extendable leg and/or footrest, a driver, a fold-out mechanism for triggering a folding movement of the leg and/or footrest during an extending and/or retracting movement of the leg and/or footrest, and a translator designed to be moved translationally by the driver and trigger the extending and/or retracting movement. The folding movement of the leg and/or footrest can be triggered by a change in the distance between the fold-out mechanism and the translator.

16 Claims, 7 Drawing Sheets

(56) References Cited

U.S. PATENT DOCUMENTS

| | | | | |
|---|---|---|---|---|
| 7,080,887 | B2 * | 7/2006 | Tseng | A47C 1/035 297/423.28 X |
| 7,273,257 | B2 * | 9/2007 | De Vroe | A47C 1/035 297/452.26 X |
| 7,824,349 | B2 * | 11/2010 | Lv | A61H 7/007 297/423.22 X |
| 8,444,225 | B2 * | 5/2013 | Behe | B64D 11/06 297/423.26 X |
| 8,444,226 | B2 * | 5/2013 | Driessen | B60N 3/063 297/423.28 |
| 8,500,664 | B2 * | 8/2013 | Numata | A47C 7/50 297/423.22 X |
| 8,573,696 | B2 * | 11/2013 | Kuno | A47C 7/506 297/284.11 |
| 8,870,289 | B2 * | 10/2014 | Yin | A47C 7/506 297/423.22 |
| 9,192,239 | B2 * | 11/2015 | Besler | A47C 1/035 |
| 9,821,692 | B2 * | 11/2017 | Vyskocil | B60N 2/995 |
| 2001/0048239 | A1 * | 12/2001 | Kogure | B60N 2/62 297/423.2 |
| 2005/0173963 | A1 * | 8/2005 | Edrich | B60N 2/62 297/423.28 |
| 2012/0181838 | A1 * | 7/2012 | Wu | A47C 7/506 297/423.2 |

FOREIGN PATENT DOCUMENTS

| | | | |
|---|---|---|---|
| JP | S6443210 | A | 2/1989 |
| JP | 2003000384 | A | 1/2003 |
| JP | 2011067355 | A | 4/2011 |
| JP | 3178456 | U | 9/2012 |
| WO | 2016142530 | A1 | 9/2016 |

* cited by examiner

SEATING FURNITURE CHASSIS WITH A RETRACTABLE AND EXTENDABLE FOOTREST

FIELD OF THE INVENTION

The present invention relates to a seating furniture chassis.

BACKGROUND

Seating furniture chassis are constructions that form the skeletal structure of a chair. Upholstery and covers are installed on the seating furniture chassis.

A seating furniture chassis is known from DE 10 2009 051 576 A1 that has a footrest that can be extended and folded out. In known seating furniture chassis, conversion means are used that convert the angular momentum of a drive means into an extending and folding-out movement of the footrest. Moreover, seating furniture chassis often have a spring suspension for a seating surface support chassis. A cushion that acts as a seating surface can be mounted on the seating surface support chassis. The conversion means and the spring suspension are usually arranged in areas that are close to each other. This arrangement runs counter to a reduction of the installation space for the retraction and extension mechanism of the footrest. If only relatively little space is to be used so that the retraction and extension mechanism is not very or not at all visible when in the retracted state, the arrangement of the spring suspension constitutes an impediment to this goal.

SUMMARY OF THE INVENTION

It is the object of the invention to provide a seating furniture chassis in which less installation space is required for the retraction and extension mechanism of the footrest. Moreover, a piece of seating furniture is to be provided with such a footrest chassis and a seating furniture chassis.

This object is achieved by means of a footrest chassis as disclosed herein and by a piece of seating furniture as disclosed herein. Embodiments of the invention are disclosed herein.

The seating furniture chassis comprises a retractable and extendable leg and/or footrest, a drive means, a fold-out means for triggering a folding movement of the leg and/or footrest during an extending and/or retracting movement of the leg and/or footrest, and a translation means that is designed to be moved translationally by the drive means and thus trigger the extending and/or retracting movement. The drive means can be embodied as a motor that transfers a torque to a shaft, for example. The torque can be converted by conversion means into a force that acts on the translation means, thereby moving the translation means translationally.

The folding movement of the leg and/or footrest can be triggered by a change in the distance between the fold-out means and the translation means. For example, the fold-out means can be connected by one or more levers to the translation means or to a component—e.g., a carriage—that is rigidly connected to the translation means such that the distance between the fold-out means and the translation means changes automatically during the extending and/or retracting movement.

According to one embodiment of the invention, the seating furniture chassis can comprise at least one guide rail and at least one guide element. The guide rail can be designed to guide the guide element during the extending and/or retracting movement. The distance between the fold-out means and the translation means can be changeable by guiding the guide element by means of the guide rail. For this purpose, the guide element can be connected to the fold-out means and the translation means or the carriage, for example.

According to one embodiment of the invention, the seating furniture chassis can comprise a first leg and a second leg. The guide element can be connected to a first end of the first leg. The connection between the guide element and the first end of the first leg can be rotatable or fixed. Moreover, the guide element can be rotatably connected to a first end of the second leg. A second end of the first leg opposite the first end of the first leg can be connected to the fold-out means. It is also possible, for example, for the first leg to be connected to the fold-out means by means of another component. A second end of the second leg opposite the first end can be rotatably connected to the translation means or to a carriage that is rigidly connected to the translation means. For example, the carriage can be moved by the translation means and rigidly connected to the translation means for this purpose.

By connecting the guide element by means of the legs to the fold-out means and the translation means or the carriage, a change in the distance between the fold-out means and the translation means can be achieved during the extending and/or retracting movement. For example, the guide element can be guided by the guide rail such that the distance between the carriage or the translation means and the guide element is changed due to the rotatable connection between the second leg and the guide element.

According to one embodiment of the invention, the distance between the fold-out means and the translation means is changeable by guiding the guide element toward the translation means or the carriage or away from the translation means or the carriage during the extending and/or retracting movement. By changing the distance between the guide element and the translation means or the carriage, a rotation of the second leg can be effected whereby the distance between the translation means and the fold-out means is changed.

According to one embodiment of the invention, a folding-in movement of the leg and/or footrest during the retracting movement can be triggered by guiding the guide element away from the translation means or the carriage during the retracting movement. A folding-out movement of the leg and/or footrest can be triggered during the extending movement by guiding the guide element toward the translation means or the carriage during the extending movement.

According to one embodiment of the invention, the translation means or the carriage can be arranged in a lateral region of the seating furniture chassis. The guide element and the guide rail can be arranged in an inner region of the seating furniture chassis. In this context, the lateral region can be understood particularly to be an area that extends forward from a rear end in an edge region of the seating furniture chassis. The rear end is the end of the seating furniture chassis to which a backrest can be attached. In particular, the lateral region can be the area that is closer to the lateral edge of the seating furniture chassis than the center. Particularly, the seating furniture chassis can have two lateral regions that run parallel to one another. The inner region can be understood in particular to be an area that lies between the two lateral regions.

According to one embodiment of the invention, the seating furniture chassis can comprise at least two guide elements, two guide rails, and two carriages. The carriages can each be arranged in one of the lateral regions. The guide elements and the guide rails can each be arranged between a center of the seating furniture chassis and the respective carriage.

The use of two guide elements, two guide rails, and two slides, the stability of the seating furniture chassis increases the stability of the seating furniture chassis, particularly during the retracting and extending movement.

According to one embodiment of the invention, the fold-out means can comprise at least one bolt, one bearing element, and one slot. The fold-out movement of the leg and/or footrest can be triggered by a translational movement of the bolt. The bolt can be guided by means of the bearing element in this translational movement in the slot. The slot can be arranged, for example, in a component that is rigidly connected directly or indirectly to the translation means. At least a portion of the leg and/or footrest can be attached to this component. Another portion of the leg and/or footrest can be connected to the bolt. A relative movement between the bolt and the slot can then be converted by means of a suitable lever conversion into the folding movement of the leg and/or footrest.

According to one embodiment of the invention, the fold-out means can comprise an additional bearing element that is arranged on the bolt. The leg and/or footrest can be placeable on the additional bearing element. By virtue of this connection between the leg and/or footrest and the bolt, it can be ensured that no body parts, animals, or objects are damaged or injured during a folding movement if they are in the path of the leg and/or footrest.

According to one embodiment of the invention, the fold-out means can comprise a spring element. The spring element can exert a spring force on the leg and/or footrest. The spring force can press the leg and/or footrest against the bolt. The spring element ensures that the leg and/or footrest is in contact with the bolt. If, during the folding movement, a body part, an animal, or an object collides with the leg and/or footrest, only the spring force acts on the body part, the animal/or the object. The resulting damage or injury can thus be reduced.

According to one embodiment of the invention, the seating furniture chassis can comprise conversion means that convert a torque generated by the drive means into a force that acts translationally on the translation means.

According to one embodiment of the invention, the conversion means can comprise a threaded spindle and a nut. The nut may be connected to the translation means and screwed onto the threaded spindle. The threaded spindle can be caused to rotate by the drive means.

According to one embodiment of the invention, the conversion means can be arranged in a central region of the seating furniture chassis. The central region can be understood as referring, in particular, to the middle third of the seating furniture chassis, with the central region extending forward from the rear end of the seating furniture chassis. In particular, it is possible for the conversion means to be arranged centrally, so that they are at the same distance from the two lateral regions.

BRIEF DESCRIPTION OF THE DRAWINGS

Additional features and advantages of the present invention will become apparent from the following description of preferred embodiments with reference to the accompanying drawings. The same reference numerals are used for same or similar components and for components with same or similar functions. In the drawings.

DETAILED DESCRIPTION OF THE INVENTION

Figure 1:
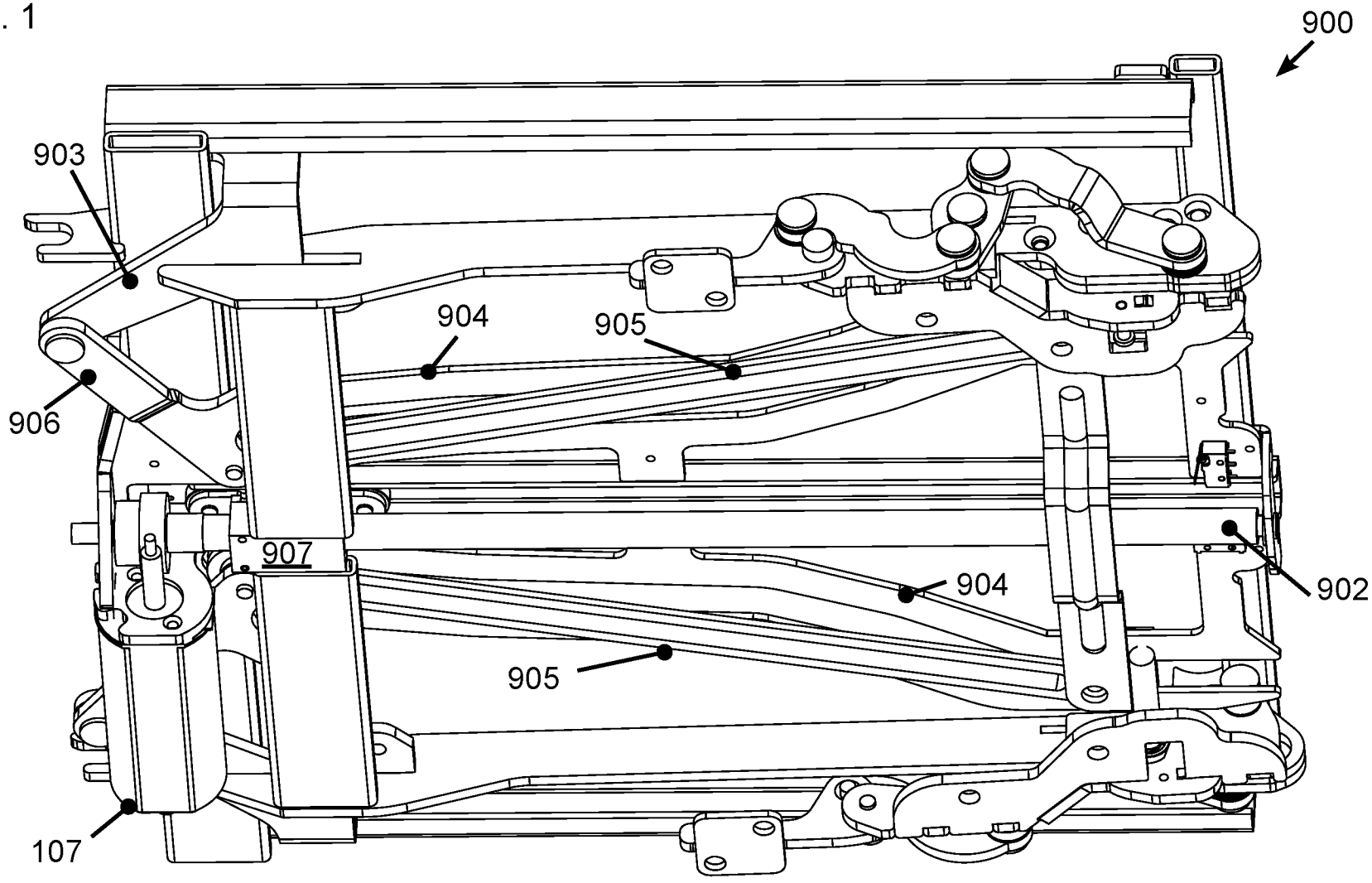
FIG. 1 shows a schematic perspective view of a seating furniture chassis according to one embodiment of the invention with retracted and folded-in leg and/or footrest.

In FIGS. 1 to 7, a seating furniture chassis 900 is shown that includes a drive means 107, a threaded spindle 902, two carriages 903, two guide rails 904, two first legs 905, two second legs 906, a translation means 907, and a leg and/or footrest 1000.

The drive means 107 is arranged in a rear region of the seating furniture chassis 900 and causes the threaded spindle 902 to rotate. The translation means 907 is connected to a nut that is screwed onto the threaded spindle 902, so that the translation means 907 is moved translationally when the threaded spindle 902 rotates. The threaded spindle 902 is arranged in the center of the seating furniture chassis 900 and extends from the rear end toward the front end.

The translation means 907 is rigidly connected to the two carriages 903, which are guided in lateral guides. Each of the carriages 903 is rotatably connected to the respective second leg 906. Moreover, each of the second legs 906 is also connected to a guide element, which is concealed in the figures. The two guide elements are guided in the guide rails 904 during translational movement of the translation means 907. In addition, the guide elements are each connected to first ends of the two first legs 905. Second ends of the first legs 905 are situated opposite the first ends and connected to one another by a connecting means 1005.

Figure 2:
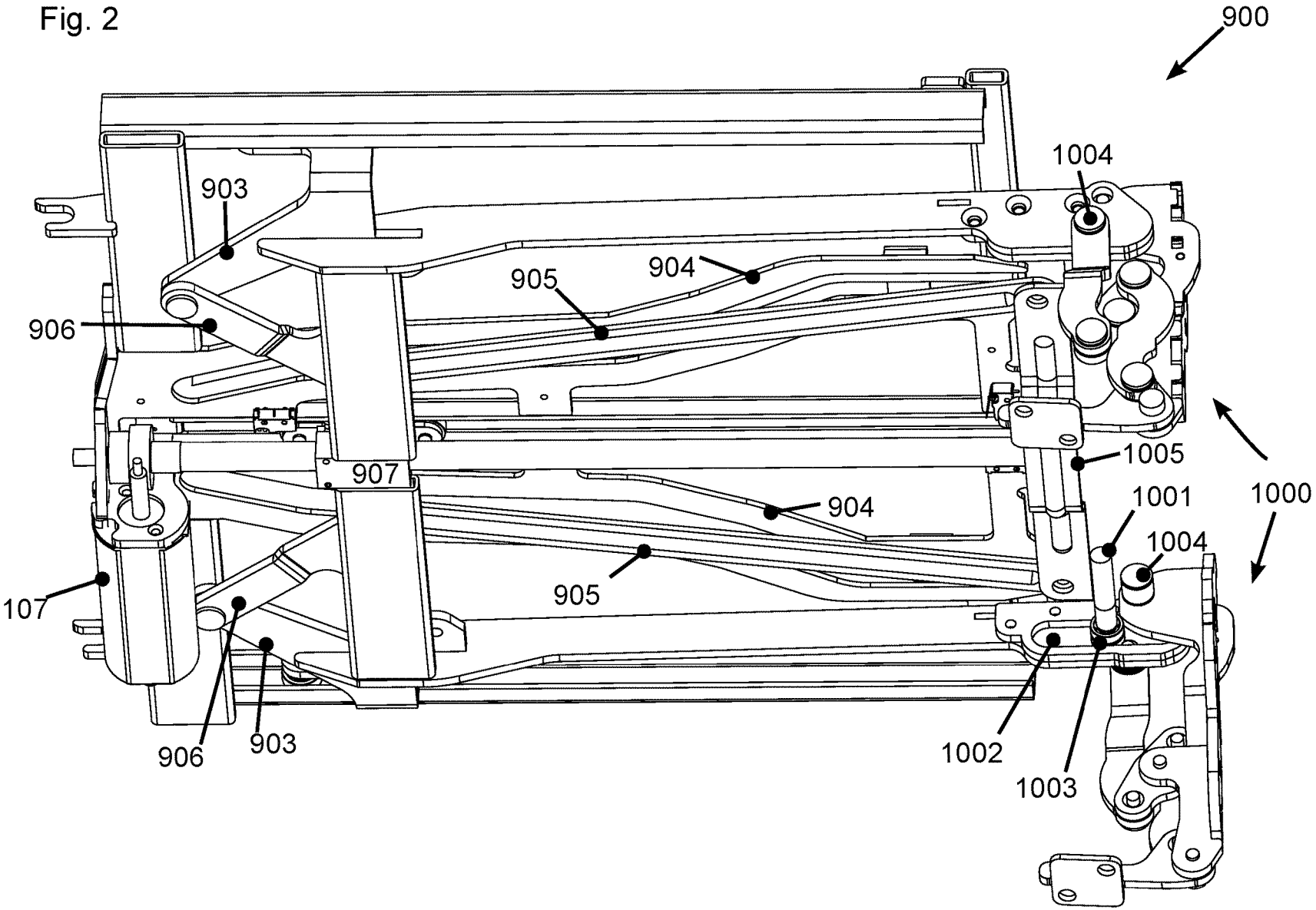
FIG. 2 shows a schematic perspective view of the seating furniture chassis from FIG. 1 with the leg and/or footrest partially extended and folded out.
Figure 3:
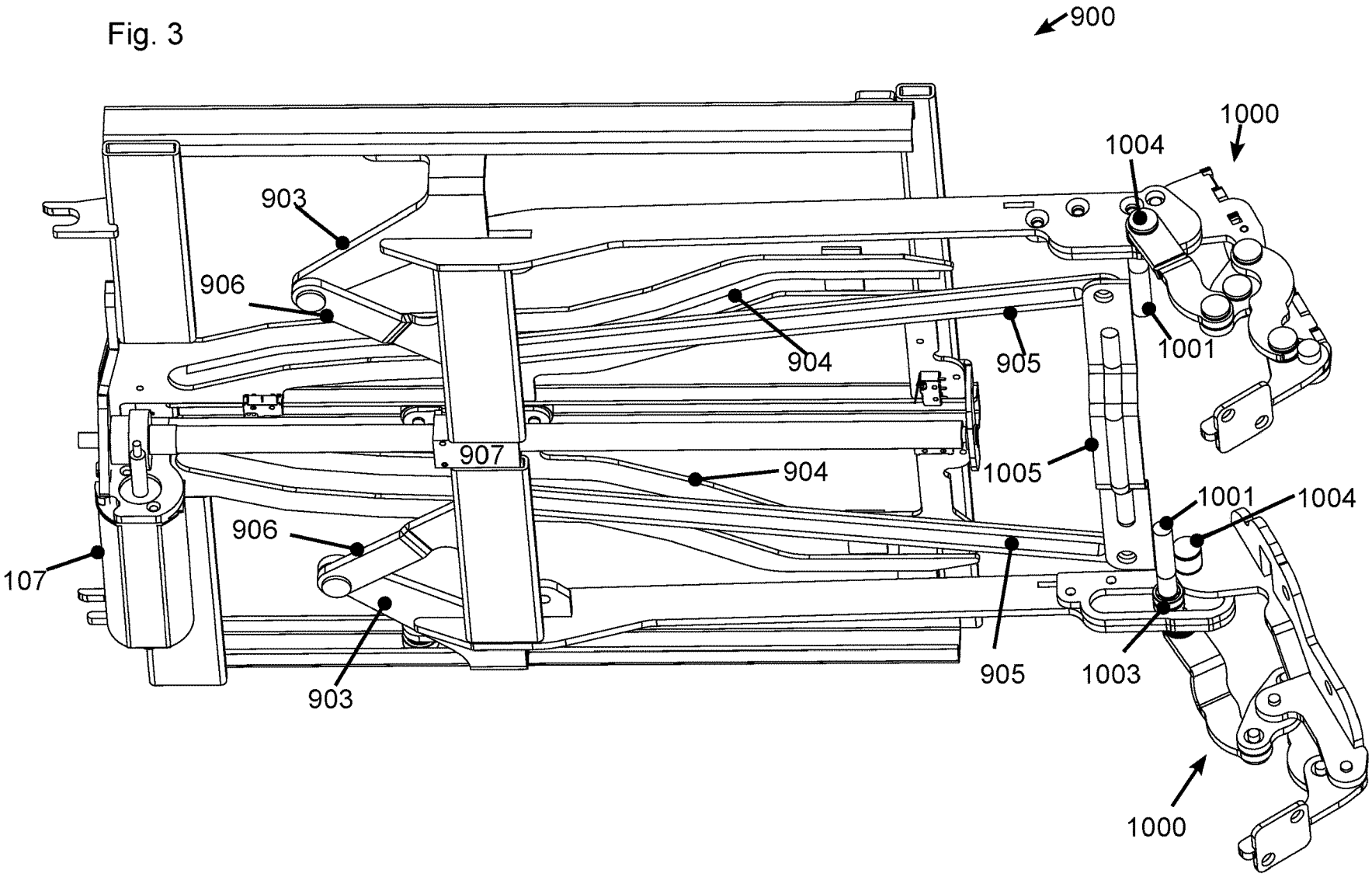
FIG. 3 shows a schematic perspective view of the seating furniture chassis from FIG. 2 with the leg and/or footrest extended and folded out further.
Figure 4:
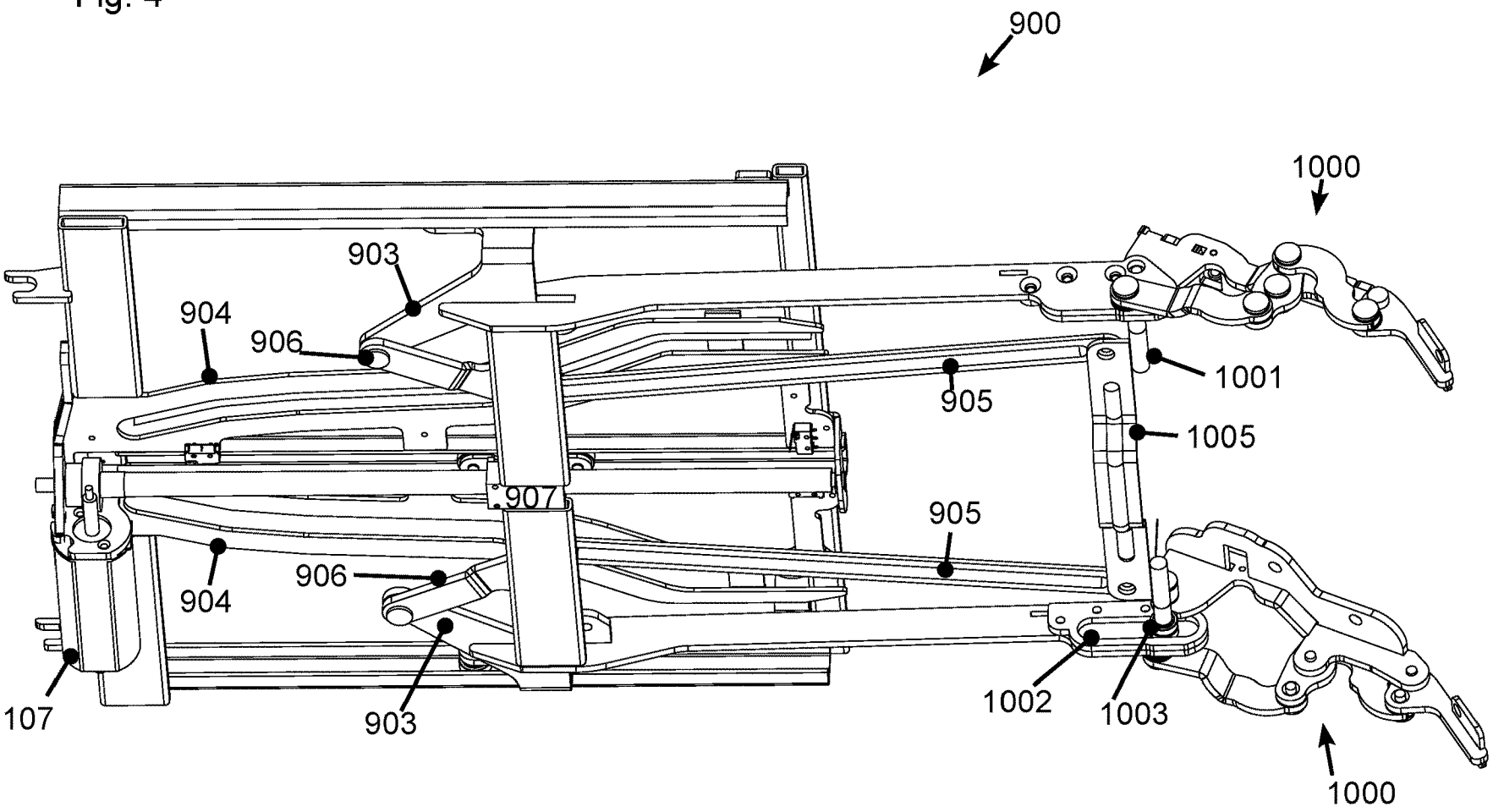
FIG. 4 shows a schematic perspective view of the seating furniture chassis from FIG. 3 with the leg and/or footrest extended and folded out further.

The guide rails 904 are respectively disposed between the threaded spindle 902 and the lateral regions of the seating furniture chassis 900. The guide rails 904 can be divided into four sections. In the first section, in which the guide elements are in the folded state of FIG. 1, the guide rails 904 extend away from one another, so that the guide elements are guided away from the threaded spindle during the folding-out process. In the second section, which adjoins the first section and in which the guide elements are located as shown in FIGS. 2 and 3, the guide rails 904 extend approximately parallel to the threaded spindle 902. The second section is followed by a third section, in which the guide rails 904 again run away from one another. The third section is followed by a fourth section, in which the guide rails 904 again run parallel to one another.

The two-part leg and/or foot rest 1000 can be swiveled about a swivel axis that is defined by a respective bearing 1004. This bearing 1004 is respectively arranged on a bearing element 1003 so as to be shifted up to a support point of the leg and/or footrest. The bearing element 1003 is connected to a bolt 1001. The bolt 1001 rests against the connecting means 1005. The bolt 1001 is guided through a slot 1002 and can be moved back and forth by a movement of the connecting means 1005 relative to the component in which the slot 1002 is arranged. When the bolt 1001 moves forward, the leg and/or footrest 1000 folds out about the swivel axis defined by the bearing 1004. Accordingly, when the bolt 1001 moves rearward, a folding-in movement occurs about the same swivel axis.

A relative movement between the bolt 1001 and the component with the slot 1002 is triggered during a translational movement of the translation means 907. The translation means 907 is moved translationally by the drive means 107 during a retracting or extending movement of the leg and/or footrest 1000.

Due to the rigid connection of the carriages 903 to the translation means 907, the carriages 903 are also moved translationally. During an extending movement, the guide elements are moved by the guide rails 904 toward the carriages 903. During a retracting movement, the guide elements are moved away from the carriages 903.

When the guide elements are moved toward the carriages 903, the second legs 906 are rotated relative to the carriages 903 such that the guide elements are pushed further forward by the second legs 906 than the translation means 907. This increases the distance between the connecting means 1005 and the translation means 907, whereby the bolt 1003 is pushed forward in the slot 1002, and the leg and/or footrest 1000 is folded out about the swivel axis 1004. When the guide elements are moved away from the carriages 903, the second legs 906 are rotated relative to the carriages 903 such that the guide elements are moved further rearward by the second legs 906 than the translation means 907. This reduces the distance between the connecting means 1005 and the translation means 906, whereby the bolt 1003 is moved rearward in the slot 1002, and the leg and/or foot rest 1000 is folded in about the swivel axis 1004.

The folding-in movement of the leg and/or footrest 1000 is supported by a spring element that presses the leg and/or footrest 1000 against the bearing element 1003. The bolt 1001 is pressed by this force against the connecting means 1005. Unlike a rigid connection, this arrangement has the advantage that, during the folding-in movement, only the spring force acts on the leg and/or footrest 1000, thereby reducing the risk of injury or damage to body parts, animals, or objects by the folding leg and/or footrest 1000.

Figure 5:
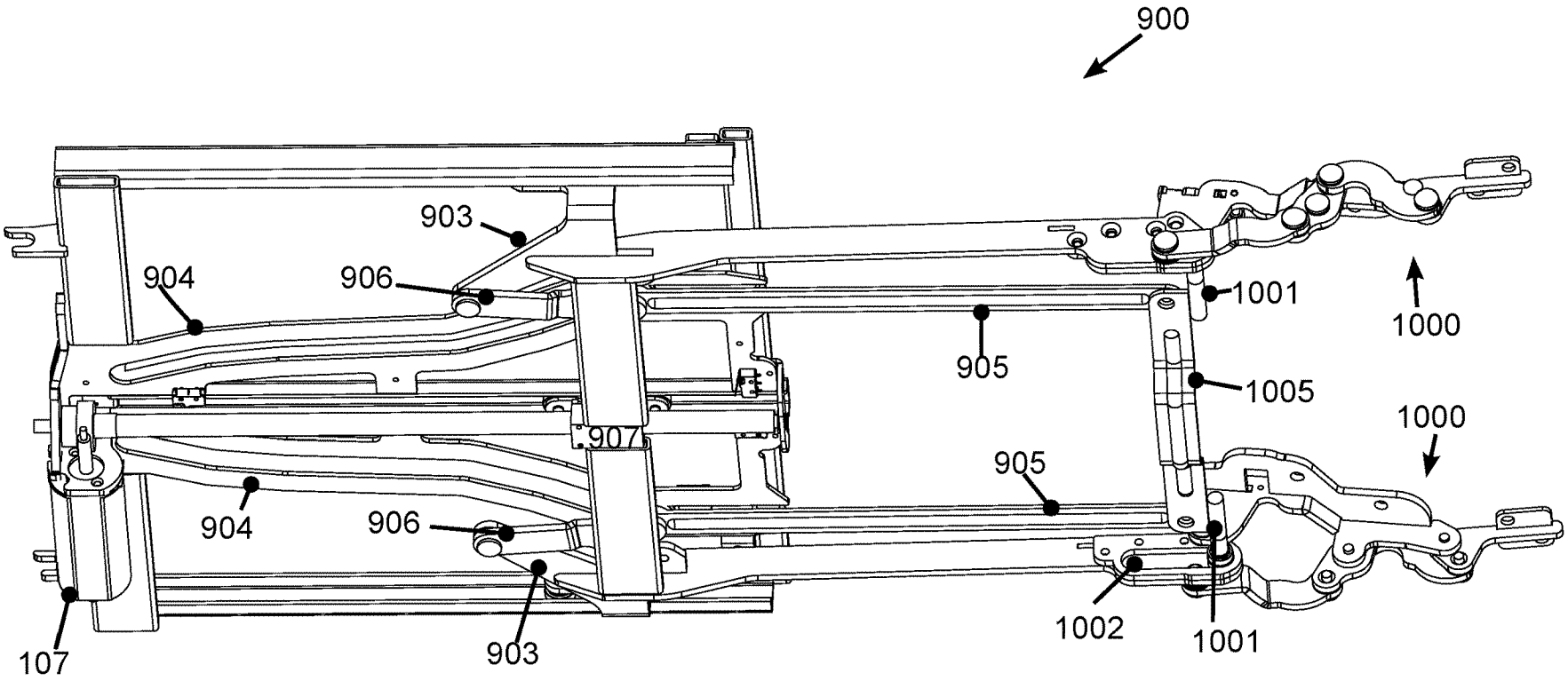
FIG. 5 shows a schematic perspective view of the seating furniture chassis from FIG. 4 with the leg and/or footrest extended and folded out further.
Figure 6:
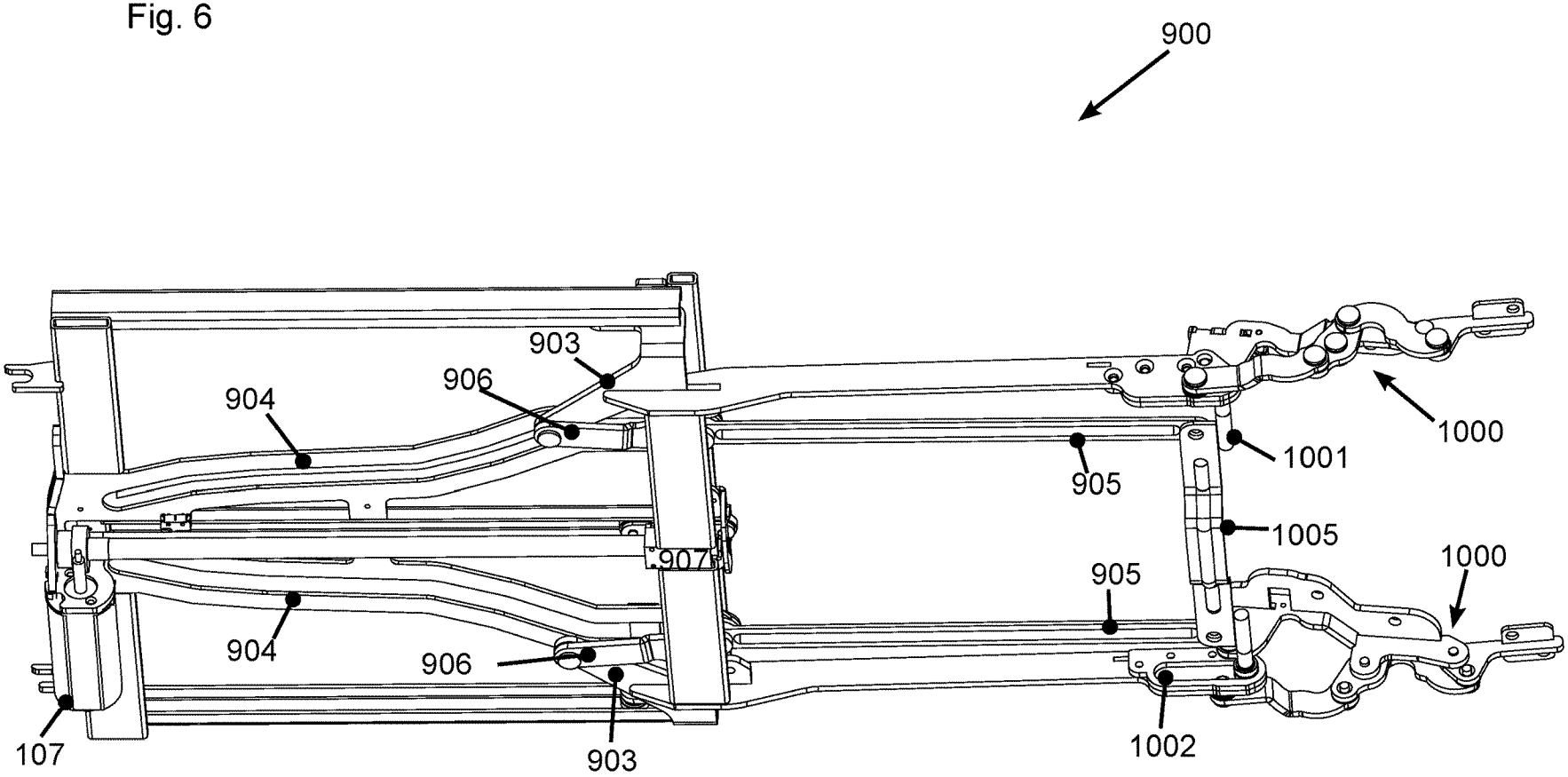
FIG. 6 shows a schematic perspective view of the seating furniture chassis from FIG. 5 with the leg and/or footrest completely extended and folded out.
Figure 7:
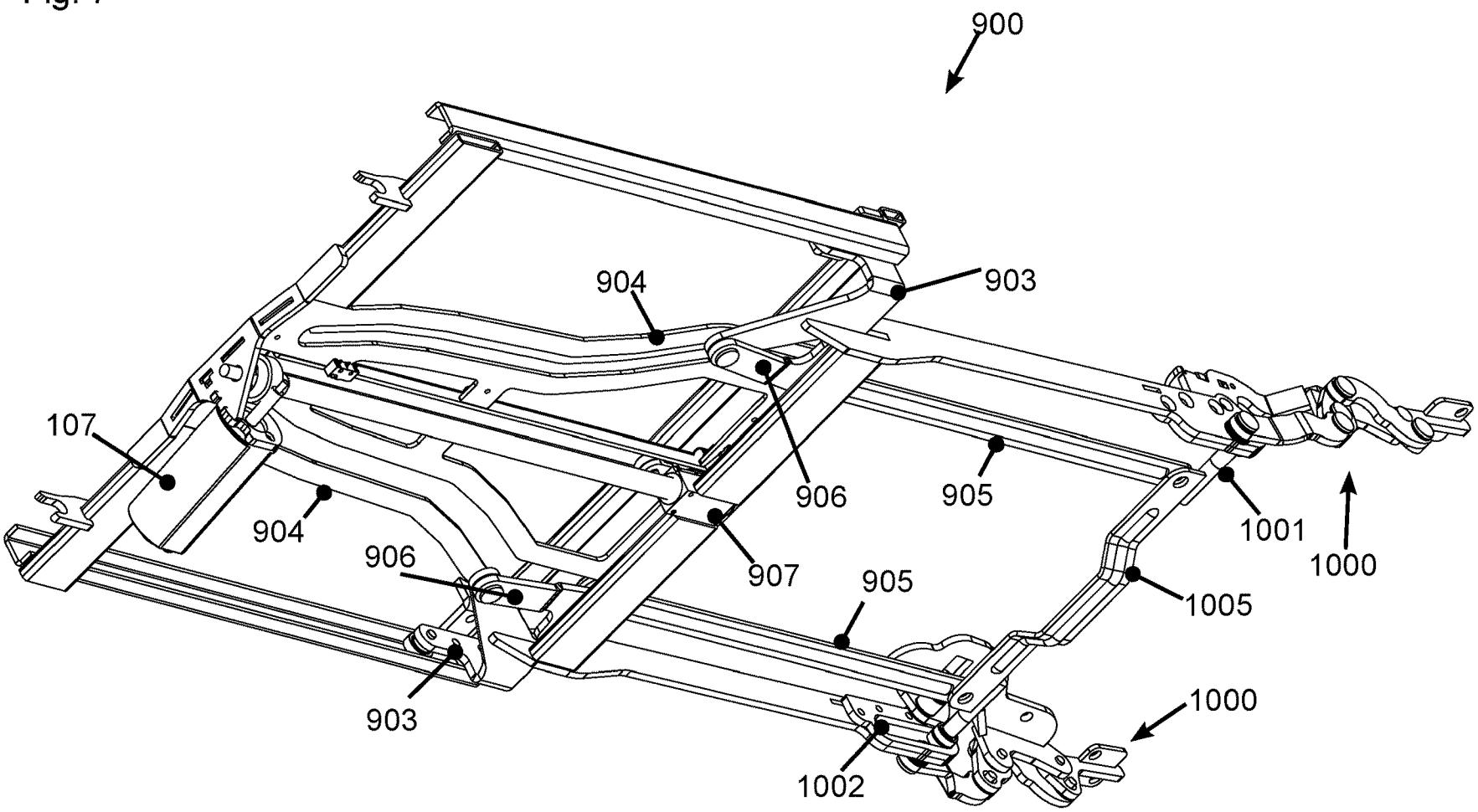
FIG. 7 shows a schematic perspective view of the seating furniture chassis according to FIG. 6.

When FIGS. 5 and 6 are viewed together, it becomes particularly clear that the seating furniture chassis 900 is well suited for people of different sizes. In FIG. 5, the footrest is already fully unfolded, but not yet fully extended. In FIG. 6, the footrest is completely unfolded and fully extended. The position of FIG. 5 is thus suitable for small people to place their feet on the footrest, while the position of FIG. 6 is suitable for taller people. The way this is achieved is that the guide rails 904 extend parallel to one another in their front regions, so that no folding movement of the footrest takes place in this portion of the extending movement.

What is claimed is:

1. A seating furniture chassis, comprising:

a retractable and extendable leg and/or footrest, a drive means, a fold-out means for triggering a folding movement of the leg and/or footrest during an extending and/or retracting movement of the leg and/or footrest, and a translation means configured to be moved translationally by the drive means and trigger the extending and/or retracting movement, wherein the folding movement of the leg and/or footrest is triggerable by a change in the distance between the fold-out means and the translation means, wherein the seating furniture chassis further comprises:

at least one guide rail and at least one guide element, the guide rail being configured to guide the guide element during the extending and/or retracting movement, and the distance between the fold-out means and the translation means being changeable by guiding the guide element with the guide rail, and wherein the guide element is connected to the fold-out means and the translation means.

2. The seating furniture chassis according to claim 1, wherein the seating furniture chassis further comprises a first leg and a second leg, the guide element is connected to a first end of the first leg, the guide element is rotatably connected to a first end of the second leg, a second end of the first leg opposite the first end of the first leg is connected to the fold-out means, and a second end of the second leg opposite the first end is rotatably connected to the translation means or to a carriage rigidly connected to the translation means.

3. The seating furniture chassis according to claim 2, wherein the distance between the fold-out means and the translation means is changeable by guiding the guide element toward the translation means or the carriage or away from the translation means or the carriage during the extending and/or retracting movement.

4. The seating furniture chassis according to claim 3, wherein a folding-in movement of the leg and/or footrest is triggerable during the retracting movement by guiding the guide element away from the translation means or the carriage during the retracting movement, and folding-out movement of the leg and/or footrest is triggerable during the extending movement by guiding the guide element toward the translation means or the carriage during the extending movement.

5. The seating furniture chassis according to claim 2, wherein the translation means or the carriage is arranged in a lateral region of the seating furniture chassis, and the guide element and the guide rail are arranged in an inner region of the seating furniture chassis.

6. The seating furniture chassis according to claim 2, wherein the seating furniture chassis comprises at least two guide elements, two guide rails, and two carriages, each of the carriages being arranged in a lateral region and the guide elements and guide rails each being disposed between a center of the seat furniture chassis and the respective carriage.

7. The seating furniture chassis according to claim 1, wherein the fold-out means comprises at least one bolt, one bearing element, and one slot, wherein the folding movement of the leg and/or footrest is triggerable by a translational movement of the bolt, and wherein the bolt is guided by the bearing element during translational movement in the slot.

8. The seating furniture chassis according to claim 7, wherein the fold-out means comprises an additional bearing element that is arranged on the bolt on which the leg and/or footrest can be placed.

9. The seating furniture chassis according to claim 7, wherein the fold-out means comprises an additional bearing element arranged on the bolt which the leg and/or footrest can be placed.

10. The seating furniture chassis according to claim 9, wherein the fold-out means comprises a spring element, with the spring element exerting a spring force on the leg and/or footrest, and with the spring force pressing the leg and/or footrest against the bolt.

11. The seating furniture chassis according to claim 9, wherein the fold-out means comprises a spring element, the spring element exerting a spring force on the leg and/or footrest, and the spring force pressing the leg and/or footrest against the bolt.

12. The seating furniture chassis according to claim 1, wherein the seating furniture chassis further comprises conversion means that convert a torque generated by the drive means into a force that acts translationally on the translation means.

13. The seating furniture chassis according to claim 12, wherein the conversion means comprise a threaded spindle and a nut, the nut being connected to the translation means, the nut being screwed onto the threaded spindle, and the threaded spindle being caused to rotate by the drive means.

14. The seating furniture chassis according to claim 12, wherein the conversion means are arranged in a central region of the seating furniture chassis.

15. A piece of seating furniture, comprising a seating furniture chassis according to claim 1.

16. A seating furniture chassis, comprising: a retractable and extendable leg and/or footrest, a drive means, a fold-out means for triggering a folding movement of the leg and/or footrest during an extending and/or retracting movement of the leg and/or footrest, and a translation means designed to be moved translationally by the drive means and trigger the extending and/or retracting movement, wherein the folding movement of the leg and/or footrest can be triggered by a change in the distance between the fold-out means and the translation means, wherein the fold-out means comprises at least one bolt, one bearing element, and one slot, and the folding movement of the leg and/or footrest can be triggered by a translational movement of the bolt, and wherein the bolt is guided by the bearing element during translational movement in the slot.

* * * * *